US010473444B1

(12) United States Patent
Gent

(10) Patent No.: US 10,473,444 B1
(45) Date of Patent: Nov. 12, 2019

(54) NECKING SIZING DIE FOR SHOULDER BREECHING RIFLE CARTRIDGES

(71) Applicant: Jeffrey Howard Gent, Brownsville, OR (US)

(72) Inventor: Jeffrey Howard Gent, Brownsville, OR (US)

( * ) Notice: Subject to any disclaimer, the term of this patent is extended or adjusted under 35 U.S.C. 154(b) by 0 days.

(21) Appl. No.: 16/371,029

(22) Filed: Mar. 31, 2019

(51) Int. Cl.
*B21K 21/04* (2006.01)
*F42B 33/00* (2006.01)
*F42B 33/10* (2006.01)

(52) U.S. Cl.
CPC ..... *F42B 33/002* (2013.01); *F42B 33/10* (2013.01)

(58) Field of Classification Search
CPC ..... F42B 33/00; F42B 33/001; F42B 33/002; F42B 33/10; F42B 33/14
See application file for complete search history.

(56) References Cited

U.S. PATENT DOCUMENTS 2,571,272 A * 10/1951 Martin ..... F42B 33/10 86/43
2,741,148 A * 4/1956 Thompson, Jr. ..... F42B 33/10 86/23
4,385,546 A * 5/1983 Lee ..... F42B 33/005 86/23
4,723,472 A * 2/1988 Lee ..... F42B 33/10 86/23
6,050,169 A * 4/2000 Voros ..... F42B 33/10 86/24
6,484,616 B1 * 11/2002 Giraud ..... B23P 23/02 86/19.5
9,970,741 B1 * 5/2018 Eldredge ..... B23B 5/16

* cited by examiner

*Primary Examiner* — Gabriel J. Klein

(57) ABSTRACT

A neck sizing die for shoulder breeching ammunition cartridge cases that uses the shoulder to align the case, not the body. Alignment occurs before resizing. Resizing is done in a two-step process: a bushing is used to shrink the neck diameter and then an expansion button is used to increase it. Bushing and button diameters are highly selectable and easily changed. Cone-and-cup interfaces ensure concentricity of the case shoulder to the bushing or button. The unique alignment technique and two-step sizing method produces a case with a neck having an interior diameter of the user's choice with the interior wall of the neck aligned to the shoulder. This results in a case that will more reliably position the bullet concentric with the bore of the barrel than existing tools and methods.

2 Claims, 1 Drawing Sheet

NECKING SIZING DIE FOR SHOULDER BREECHING RIFLE CARTRIDGES

CROSS-REFERENCE TO RELATED APPLICATIONS

Not Applicable

BACKGROUND OF THE INVENTION

This invention pertains to the making of ammunition cartridges for rifles such as those used by hunters, military, and competitive shooters.

Rifle chamber and ammunition cartridge designations are standardized by the Sporting Arms and Ammunition Manufacturer's Institute (SAAMI). ANSI maintains a corresponding standard Z299.4. These standards define, among other things, the physical dimensions of the cartridge and chamber for each cartridge designation by way of a mechanical drawing specifying the dimensions and tolerances for each feature. These dimensions and tolerances dictate how the cartridge will fit into the chamber, take into account changes in the cartridge dimensions during firing, and also account for normal manufacturing variation to ensure that all commercial ammunition will function in all commercial rifles. Allowable variations are small but they can have a significant effect on accuracy because they may alter the way a bullet enters the barrel, which effects how it leaves the barrel, which affects downrange accuracy. One of the motivations for hand loading ammunition is to take advantage of the ability to adjust the final dimensions of the cartridge to closely match the chamber of a particular rifle and to also decrease the variation from cartridge to cartridge thereby increasing accuracy and consistency.

Ammunition cartridges are assembled from a case, a primer, powder, and a bullet and are put into several broad classes based on the type of case that is used: rimmed, rimless, and belted being the most common types. Each of these three types of case use a different physical feature on the case to locate the case inside the chamber, which is commonly called 'headspacing' but within the SAAMI specification this is called 'breeching'. Rimmed and belted cases are breeched by ("headspace off of" is the common terminology) the rim or belt, both features being located at the head of the case (end opposite the bullet). Rimless cases are breeched by ("headspace off of") the shoulder, the conical transition between the larger cylindrical body of the case, which holds the powder, and the smaller cylindrical neck, which holds the bullet. This is a difference that the prior art has not addressed. All of the different reloading die, overall-length-gauges, bullet comparators, other tools, and the techniques for using them that are contained in the prior art and commercially available make no differentiation between these different case types, essentially treating all of them as if they were of the rimmed type where all critical dimensions are taken from the head of the case and alignment is controlled by adjustments to the body and neck of the case. However, for rimless shoulder breeching cartridges critical dimensions are properly referenced to the case shoulder and it is the case shoulder that should be used to align the bullet.

Among the issues that the existing technology is not handling correctly, for shoulder breeching cartridges, is the concentricity of the bullet with the bore of the barrel. The bullet is always slightly larger than the bore so the bullet is deformed as it is forced into and down the barrel, which forces the outer surface of the bullet into the rifling grooves, which causes the bullet to spin about the central axis of the barrel (not the central axis of the bullet). If the central axis of the bullet (which presumably goes through the center of mass) is not perfectly co-axial with the axis of the barrel then the bullet will be asymmetrically deformed and the center of mass will be forced to rotate about the axis of rotation. The result is a bullet which wobbles in flight, which has an unpredictable, and therefore deleterious, effect on downrange accuracy.

The problem with the existing tools and techniques appears to arise from a lack of appreciation of what the shoulder is doing in a shoulder breeching cartridge. For rimmed and belted cartridge cases the shoulder is just a transition between the enlarged body and the neck and it does not contact the shoulder of the chamber. Rimmed and belted cases rely on the interface of the rim and belt with the face of the rifle chamber to control the depth of the bullet and on the fitment of the body with the walls of the chamber to control concentricity. Therefore, in rimmed and belted cases the shoulder doesn't contribute to accuracy and can be ignored. Careful hand loaders, particularly competitive shooters using what is commonly called 'bench rest' loading techniques and tools (which do not take into account what the shoulder is doing) therefore spend a great deal of time worrying about aligning the exterior of the neck to the body in an effort to control concentricity of the bullet and the bore of the barrel. However, in a shoulder breeching cartridge the shoulder of the case is pushed against the shoulder of the chamber. This forced contact between case and chamber at the shoulder is what aligns the case and controls bullet depth. The body does not contact the chamber walls, so it is the body that should be ignored, not the shoulder.

This is a critical distinction that is being ignored by the existing technology so I have designed a set of tools for loading cartridges that are similar to existing tools but are designed specifically for shoulder breeching rifle cartridges. This includes tools for measuring the chamber and ammunition properly, a case hone, a neck sizing die, and a bullet seating die, each of which is the subject of a separate invention disclosure. This disclosure is for the neck sizing die.

This invention solves another weakness in existing designs that only resize the outer surface of the case neck. Any variation in wall thickness will cause the inner surface to be out of alignment and improperly sized even if the outer surface is perfectly aligned and sized. Because the inner surface of the neck is what positions the bullet, it is the concentricity of the inner surface with the bore of the barrel which affects accuracy. To resolve this tools have been developed that purport to ensure uniform wall thickness so that it can be presumed that alignment of the outer surface implies alignment of the inner surface. A better solution is to directly ensure that the interior surface is the correct diameter and properly aligned.

BRIEF SUMMARY OF THE INVENTION

The object of this invention is better control of bullet concentricity for shoulder breeching rifle cartridges than existing tools and methods provide, thereby producing an appreciable improvement in accuracy. Herein disclosed is a novel design for a neck sizing die that is operated in a two-step process. First, the neck diameter is reduced until the interior diameter is slightly too small. Then, the interior of the neck is expanded to the correct diameter while also being made concentric with the shoulder of the case.

Similar to other bushing style sizing die, the Shoulder Breeching Neck Sizing Die uses replaceable bushings. A unique element of this design is that the bushing exterior is not a cylinder that fits into a cylindrical hole in the die. Instead, these bushings have a conical shoulder that mates to a conical cup in the top of the die. This cup-and-cone arrangement provides better control of the position of the working surface of the bushing than is possible with the cylinder-and-hole arrangement used by existing designs. Also unique is the use of buttons. Bushings have a hole that is pressed over the outside of the neck to reduce the diameter of the neck. Buttons have a cylindrical tip that is pressed into the interior of the neck to increase the size of the neck. By first using a bushing to reduce the neck and then a button to expand it this design ensures that the axis of the interior surface of the neck is concentric with the shoulder and that the interior is the desired diameter. Other designs create a case with the exterior surface of the neck concentric with the body of the case. Because the bullet is held by the interior surface of the neck the Shoulder Breeching Neck Sizing Die will produce a case that holds the bullet concentric to the bore of the barrel with greater precision than existing die designs.

Rifle ammunition exists in a large number of cartridge types, each having different dimensions. Critical dimensions of the die, like other reloading die, must be sized to match a particular cartridge. Bushings and buttons must be made in a large range of sizes to accommodate the full range of cartridge neck diameters and to provide a fine gradation of adjustment.

Hand loaders use a variety of presses. Rising ram o-frame and c-frame, turret, or progressive are the most common types and these typically use the same type of die. Bench-rest shooters often use a press similar to a machinist's arbor press, which requires a different type of die. The preferred embodiment of the design presented here is an arbor press style die, but the design is adaptable to other types of presses as well.

DETAILED DESCRIPTION OF THE INVENTION

Figure 1:
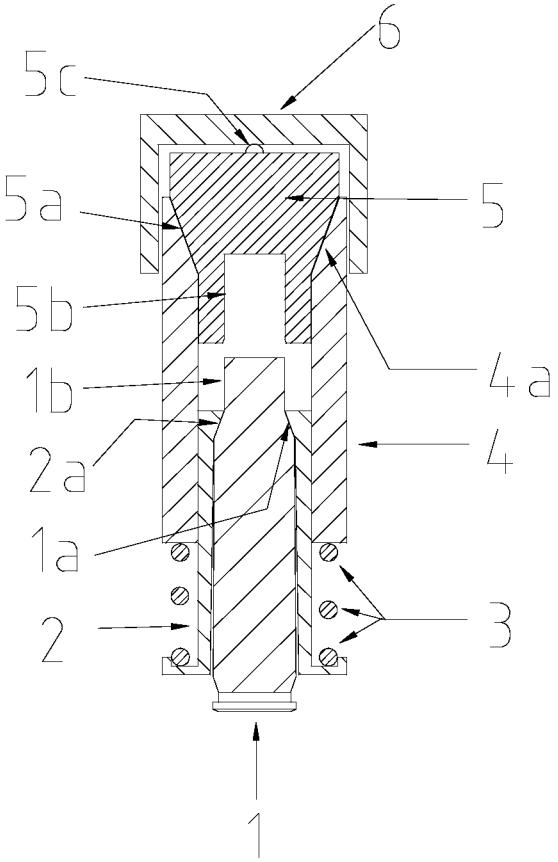
FIG. 1 illustrates, in cut-away profile view, the preferred embodiment of the Shoulder Breeching Neck Sizing Die with a bushing installed and a case inserted into the die. All parts of the die are made of tool steel or similar material. A cartridge case (1) is inserted into a chamber in the case carrier (2); which terminates with a conical cup (2*a*) having a nominal diameter and cone angle that matches the shoulder (1*a*) of the case. A spring (3) sits between the case carrier (2) and the shell (4). The upper end of the shell (4) terminates with a conical cup (4*a*). A bushing (5) sits in the conical cup (4*a*) of the shell (4); it has a conical shoulder (5*a*) with a cone angle and nominal diameter matching the conical cup (4*a*) of the shell (4), a blind bore (5*b*) that is co-axial with the shoulder (5*a*), and a semi-circular push-point (5*c*) on the top. A cap (6) sits over the bushing (5), resting on the push-point (5*c*).
Figure 2:
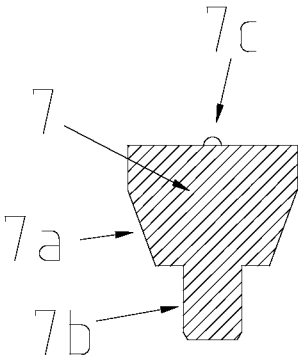
FIG. 2 illustrates a button (7) which can replace the bushing (5). The button (7) has a conical shoulder (7*a*) matching the cup (4*a*) of the shell (4), a cylindrical tip (7*b*) coaxial with the shoulder (7*a*), and a push-point (7*c*).

The Shoulder Breeching Neck Sizing Die reshapes the neck (1*b*) of a case (1) in a unique way that reforms the interior of the neck into a cylinder of a specified diameter that is concentric with the shoulder (1*a*). The preferred embodiment presented here is for use with an arbor press, which is favored by many competitive shooters. With minor changes to the exterior a similar die can be used in other types of presses as well.

This die presents a unique approach to controlling concentricity based upon the observation that if two conical surfaces having the same cone angle and median diameter are fully in contact with each other then the axis of those two surfaces must be co-axial. (For the purposes of this invention, if two things are co-axial they are also concentric.) Therefore, all non-moving critical interfaces in this die are conical surfaces with matching cone angles and median diameters. The case (1) interfaces with the case carrier (2) at the shoulder (1*a*) by means of a conical cup (2*a*) with a matching median diameter and cone angle. This is the only contact point between the case (1) and case carrier (2). The bushing (5) and button (7) have conical shoulders (5*a* and 7*a*) with median diameters and cone angles that match the conical cup (4*a*) in the shell (4). This ensures that the bushing bore (5*b*) and button tip (7*b*) are co-axial with the case shoulder (1*a*).

This die design takes a unique two-step approach to resizing the neck (1*b*). In the first step the bushing (5) is used to reduce the neck diameter. In the second step the bushing (5) is replaced with the button (7), which is then used to expand the interior of the neck (1*b*) while simultaneously aligning it to the case shoulder (1*a*).

Bushings (5) will be made in a fine gradation of bore (5*b*) diameters. For the first step in the process the user will select a bushing (5) with a bore (5*b*) having the proper diameter and place it into the cup (4*a*) in the shell (4) and then cover it with the cap (6). The proper diameter will be that which results in an interior neck diameter that is slightly smaller than what the final interior diameter needs to be. A case (1) is inserted into the case carrier (2) and the assembly is placed under an arbor press and compressed.

When the assembly is compressed an important sequence of events takes place. First, the ram of the arbor press will press on the cap (6), which presses on the push-point (5*c*) (a hemispherical bump located in the center of the top of the bushing), which ensures that the force from the press is directed along the axis of the bushing (5). This compresses the bushing shoulder (5*a*) against the cup (4*a*) in the shell (4). This ensures that the bushing bore (5*b*), which is co-axial with the bushing shoulder (5*a*), is now also co-axial with the cup (4*a*) in the shell (4). Simultaneously with this the spring (3) transfers this compressive force from the shell (4) to the case carrier (2), which presses the conical cup (2*a*) against the case shoulder (1*a*), which presses the case (1) against the base of the arbor press. This compressive force ensures that the case shoulder (1*a*) is co-axial with the conical cup (2*a*), which is co-axial with the shell (4), which is co-axial with the bushing bore (5*b*).

Then, after the above alignment process takes place, the first step in the resizing process is concluded upon further lowering of the arbor press ram, which compresses the spring (3), which causes the case carrier (2) to slide inside the shell (4), which causes the bushing bore (5*b*) to be pressed onto the case neck (1*b*), which reduces the neck diameter while also forcing it to become co-axial with the case shoulder (1*a*).

For the second step in the resizing process the bushing (5) is replaced with a button (7), which will be made in a fine gradation of tip (7*b*) diameters. The user will choose a button (7) with a tip (7*b*) diameter that is the same as the desired final neck (1*b*) interior diameter and place it in the cup (4*a*) of the shell (4). The cap (6) is replaced and the assembly is once again compressed with an arbor press. The same sequence of events takes place: first, the various parts of the assembly settle into alignment with each other so that the tip (7*a*) of the button (7) becomes co-axial with the case shoulder (1*a*); then, the tip (7*a*) is pressed into the case neck (1*b*). The final result is a case (1) with a neck (1*b*) having an interior surface that is known to be cylindrical; has a known diameter; and is co-axial with the case shoulder (1*a*).

I claim:

1. An apparatus for forming or reforming an ammunition cartridge case, said case comprising a head, said case further comprising a body, said case further comprising a conical shoulder, said case further comprising a neck, said apparatus comprising:

a case-carrier, said case-carrier comprising a chamber into which said case is inserted during operation of said apparatus, said chamber comprising a conical shoulder with a cone angle and median diameter substantially equal to the cone angle and median diameter of said shoulder of said case;

a shell comprising a bore housing said case-carrier, said case-carrier translating within said bore of said shell during operation of said apparatus, said bore terminating in a conical shoulder co-axial with said bore;

a die-head comprising a conical shoulder having a cone angle and median diameter substantially equal to the cone angle and median diameter of said shoulder terminating said bore in said shell, said die-head being pressed into said shoulder terminating said bore in said shell during operation of said apparatus;

said die-head further comprising a bore into which said neck of said case is pressed during operation of said apparatus;

a means by which a compressive force can be maintained across a conical interface between said shoulder of said case and said shoulder of said chamber of said case-carrier, said means simultaneously maintaining a compressive force across a conical interface between said shoulder of said die-head and said shoulder terminating said bore in said shell, said means establishing said compressive forces during operation of said apparatus prior to direct contact between said neck of said case and said die-head, said compressive forces originating in a compressive force applied between said head of said case and said die-head, said means including a spring between said case-carrier and said shell.

2. The apparatus according to claim 1, wherein the die-head is replaceable with a die-head having a cylindrical protrusion that is inserted into said neck of said case during operation of said apparatus.

* * * * *